United States Patent [19]

Sugiura et al.

[11] 4,378,343

[45] Mar. 29, 1983

[54] PROCESS FOR PRODUCING CARBON FIBER TOWS

[75] Inventors: Akira Sugiura; Shigeru Sawanishi; Kunio Maruyama, all of Okayama, Japan

[73] Assignees: Sumitomo Chemical Co., Ltd.; Japan Exlan Co., Ltd., both of Osaka, Japan

[21] Appl. No.: 366,414

[22] Filed: Apr. 7, 1982

Related U.S. Application Data

[63] Continuation of Ser. No. 182,402, Aug. 26, 1980, abandoned.

[30] Foreign Application Priority Data

Sep. 25, 1979 [JP] Japan ..... 54-123487

[51] Int. Cl.[3] ..... D01F 9/22

[52] U.S. Cl. ..... 423/447.4; 264/29.2; 423/447.1; 423/447.6

[58] Field of Search ..... 423/447.4, 447.6, 447.1; 264/29.2

[56] References Cited

U.S. PATENT DOCUMENTS

| | | | |
|---|---|---|---|
| 3,817,700 | 6/1974 | Menikheim | 423/447.4 |
| 4,029,248 | 2/1977 | Kishimoto et al. | 423/447.4 |
| 4,259,307 | 3/1981 | Maruyama | 423/447.4 |
| 4,284,615 | 8/1981 | Maruyama | 423/447.4 |

*Primary Examiner*—Edward J. Meros

*Attorney, Agent, or Firm*—Wenderoth, Lind & Ponack

[57] ABSTRACT

A process for producing a carbon fiber tow from an acrylic fiber tow wherein the acrylic fiber tow is treated to uniformily contain throughout the two (1) an aminosiloxane and (2) a chemical substance selected from glycerine, an alkylene glycol, and a polyalkylene glycol prior to heat-treating said acrylic fiber tow to produce the carbon fiber tow whereby problems such as fluffiness, spreading, and filament breakage are diminished.

6 Claims, No Drawings

PROCESS FOR PRODUCING CARBON FIBER TOWS

This is a Continuation Application of application Ser. No. 182,402, filed Aug. 26, 1980, now abandoned.

The present invention relates to a process for producing carbon fiber tows (hereinafter referred to as carbon tows, which include graphite fiber tows). More particularly, the invention is concerned with a process for producing high-quality carbon tows suitable for use as reinforcements, wherein an acrylic fiber tow (hereinafter referred to as precursor tow) prepared so as to contain a particular aminosiloxane and a particular chemical substance in a uniform state is subjected to thermal stabilization and carbonization treatments.

It is already known that carbon fibers can be obtained by thermally stabilizing acrylic fibers in an oxidizing atmosphere and then carbonizing the thus thermally stabilized acrylic fibers in a non-oxidizing atmosphere. But it is to be noted that the thermal stabilization reaction (oxidation reaction) of the acrylic fibers is an exothermic reaction, so that when the fibers are heated rapidly, local accumulation of heat takes place and non-uniform reactions are liable to occur; because of this, in the thermal stabilization step, the fibers are fused or agglutinated together or become brittle, and therefore it is very difficult to obtain high-quality carbon fibers. To overcome such technical difficulties, various proposals have been made, for example, such as a process wherein the thermal stabilization is carried out at a low temperature and for a long time, or a process as described in Laid-open Japanese Patent Application No. 117724/1974 wherein the precursor substrate is impregnated with or caused contain an organic silicone substance and thereafter it is thermally stabilized. However, these processes still have problems remaining unsolved. Namely, when such a particular substance is employed, the agglutination and fusion of the acrylic fibers can be reduced to some extent indeed, but on the other hand, owing to the water repellency of the silicone substance used, the acrylic fibers are liable to generate static electricity. When static electricity is generated, there will be caused grave difficulties such as fiber entanglement upon taking out fibers, fiber winding about rollers or guides in the steps of thermal stabilization and carbonization, generation of fluff, etc. and the operation is made seriously unstable.

Among others, when a precursor tow produced by wet-spinning process is used, the tow shape is markedly disordered by the repulsion due to static electricity between single fibers, and therefore it has been difficult to obtain a satisfactory carbon tow. As an attempt to solve this difficulty, it is possible to employ the method proposed in Japanese Patent Publication No. 24136/1977, but the addition of a prescribed amount of aminosiloxane only will still cause various problems upon handling a precursor tow composed of a large number of single filaments. Namely, when the number of single filaments composing the precursor tow exceeds 10,000, a remarkable quantity of static electricity is generated between single filaments in the drying step (before the thermal stabilization step) and in the thermal stabilization step and puts the two shape into disorder. Also, accompanied with the increase in the number of single filaments, the diffusion of the heat generated by condensation, cyclization etc. reactions in the thermal stabilization step will become markedly slow, so that an effective diffusion of heat is impeded. This results in a tendency of local formation of pitch- or tar-like substances.

Thus, when static electricity is generated between single filaments of a precursor tow and agglutination or fusion is induced therefrom, there will be caused, in the heat treatment steps, troubles such as entanglement of tow filaments around rollers or guides, generation of fluff, etc.; these troubles not only further lower the operation efficiency but also finally make it difficult to produce a high-quality carbon tow having excellent physical properties.

In such a situation, we researched intensively to obviate the above-mentioned defects and to obtain carbon tows having excellent physical properties. As a result, we found that, by heat-treating a precursor tow produced so as to contain a particular chemical substance together with the above-mentioned aminosiloxane, and so as to diminish the variation in the contents of the two substances between divided portions of the tow, it is possible to obviate all the troubles such as the fluffiness, spreading, filament breakage, etc. of the precursor tow and at the same time, to markedly improve the stability in the operation of the carbon tow production process. The present invention is based on this finding.

Therefore, an object of the present invention is to provide an improved process for producing carbon tows having excellent physical properties.

Another object of the present invention is to provide a process for producing carbon tows, which makes it possible to eliminate such troubles as the fluffiness, spreading, fusion, etc. of the tow, and to produce carbon tows having a high tensile strength and a high modulus of elasticity and free from agglutination and fusion between single filaments, by heat treatment for a short time.

Other objects of the present invention will become apparent from the following concrete explanation of the invention.

In producing carbon tows from precursor tows, the above-mentioned objects of the present invention can be attained by heat-treating a precursor tow prepared in such a manner that the total number (X) of single filaments composing the pecursor tow is 10,000 or more, that said tow contains an aminosiloxane represented by the following general formula:

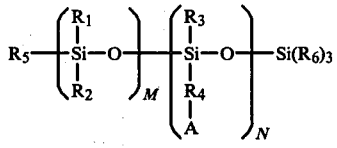

wherein each of $R_1$, $R_2$ and $R_3$ represents hydrogen, methyl, ethyl or phenyl; $R_4$ represents $-C_nH_{2n}-$ (wherein n is an integer from 1 to 10) or phenylene; each of $R_5$ and $R_6$ represents hydrogen or $-C_nH_{2n+1}$ (wherein n is an integer from 1 to 5); each of M and N represents an integer from 1 to 100,000 (wherein $M+N>10$); and A represents

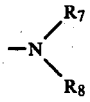

(wherein each of $R_7$ and $R_8$ represents hydrogen, alkyl whose number of carbon atoms is not more than 10 or phenyl), or

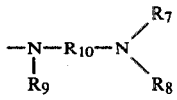

(wherein $R_9$ represents H, $C_nH_{2n+1}$ ($n=1\sim5$) or phenyl, and $R_{10}$ represents $C_nH_{2n}$ ($n=1\sim10$) or phenylene), and a chemical substance selected from the group consisting of glycerine, an alkylene glycol whose number of carbon atoms is not more than 6 and a polyalkylene glycol whose number of carbon atoms is not more than 20, and in such a manner that when the precursor tow composed of X single filaments is so divided into Y portions (divided tows) that each divided tow will be composed of 1000 filaments $$\left(\text{i.e. } Y = \frac{X}{1000}\right),$$

the number of divided tows whose content in the aminosiloxane is not more than 0.05 weight % based on the dry weight of the fibers, is not more than 10% relative to Y, and the number of divided tows whose content in said chemical substance is not more than 0.08 weight % based on the dry weight of the fibers, is not more than 20% relative to Y.

In this way, by introducing two kinds of the particular treating substances into the structure of the precursor tow, the generation of static electricity is suppressed and at the same time appropriate bundling properties are given to the tow. This prevents fluff generation and entanglement of filaments around guides and rollers in the thermal stabilization step, and furthermore markedly suppresses the agglutination and fusion between single filaments. Consequently, there are no fluff generation and no entanglement of filaments around guides and rollers in the subsequent carbonization step. All these effects are outstanding characteristics of the present invention. In other words, the technical effects peculiar to the present invention are exhibited as a result of a synergetic action of the two particular substances employed, and if any one of said substances is lacking, the objects of the present invention cannot be attained.

Precursor tows, after once packed up in boxes or wound on spools, are introduced into the thermal stabilization and carbonization steps. Upon such packing up in boxes, winding on spools, or taking the tows out of boxes or spools, when the tows have been treated with the two kinds of the particular substances according to the present invention, there is no substantial generation of static electricity, and the tows can be handled with ease, and finally it is possible to produce carbon tows with excellent physical properties and free from agglutination and fusion.

Furthermore, when the contents of the two kinds of the particular treating substances are made uniform between the divided tows (each composed of 1000 filaments of the precursor tow) by a prescribed means, substantially the same heat treatment behavior as in the case of a tow composed of 1000 filaments can be attained, so that even if the total number of single filaments composing the tow is 10,000 or more, it is possible to produce carbon tows with excellent physical properties.

Moreover, it is possible to prevent rapid local accumulation of heat due to slow heat diffusion resulting from an increased number of constituent single filaments.

The precursor tows used in the present invention are those produced from an acrylonitrile copolymer containing combined therewith at least 85 mol %, preferably more than 90 mol % acrylonitrile, and copolymerized with 0.3–6 mol % preferably 0.5–3 mol % of a carboxyl group-containing unsaturated monomer, in accordance with any of the usual spinning processes (for example wet-spinning process, dry-wet-spinning process, etc.) and after-treatments (cold water stretching, hot water stretching, gel treatment, steam stretching, drying, etc.), and are fiber bundles composed of 10,000 or more single filaments. Among the above-mentioned carboxyl group-containing unsaturated monomers, there can be mentioned acrylic acid, methacrylic acid, itaconic acid, etc. Besides such unsaturated monomers, it is also permissible to use known unsaturated vinyl compounds such as allyl alcohol, methallyl alcohol, oxypropioacrylonitrile, methyl acrylate, methyl methacrylate, acrylamide, N-methylol acrylamide, etc.

As the precursor tows to be used in the present invention, it is preferable to employ water-swollen tows (in a gel state) after spinning and heat stretching, because the tow shape related with its handling, bundling, etc. properties is maintained in a good state throughout the precursor tow and carbon tow production steps, and also upon the treatment with the above-mentioned two kinds of the particular substances, it is possible to cause said two substances to penetrate into the core of the filaments of the tow. The above-mentioned water-swollen tows mean those containing 20–200 weight % water based on the dry weight of the fibers after spinning and before drying.

The aminosiloxanes to be used in the present invention are those represented by the following general formula and are liquids having a viscosity (at room temperature) of 50 to 1,000,000 centipoises, preferably 100 to 10,000 centipoises;

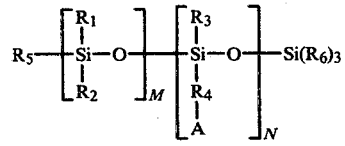

wherein each of $R_1$, $R_2$ and $R_3$ represents hydrogen, methyl, ethyl or phenyl; $R_4$ represents $-C_nH_{2n}-$ (wherein n is an integer from 1 to 10), or phenylene; each of $R_5$ and $R_6$ represents hydrogen or $-C_nH_{2n+1}$ (wherein n is an integer from 1 to 5); each of M and N represents an integer from 1 to 100,000 wherein $M+N>10$); and A represents

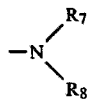

(wherein each of $R_7$ and $R_8$ represents hydrogen, alkyl whose number of carbon atoms is not more than 10, or phenyl).

Such an aminosiloxane is preferably contained in the precursor tow in an amount of 0.01–5 weight % based on the dry weight of the fibers.

On the other hand, the chemical substance to be used together with the aminosiloxane is selected from the group consisting of glycerine, an alkylene glycol whose number of carbon atoms is not more than six, preferably not more than three, and a polyalkylene glycol whose number of carbon atoms is not more than 20, preferably from 5 to 15. As concrete examples of such chemical substances, there can be mentioned glycerine, ethylene glycol, propylene glycol, butylene glycol, polyethylene glycol, polypropylene glycol, polybutylene glycol, etc. (these glycols are not limited for the molecular weight). It is also desirable that such a chemical substance should be contained in the prescursor tow finally in an amount of 0.01–5 weight % based on the dry weight of the fibers.

In order to cause these two substances to be contained in the precursor tow, a combination of the following methods is suitably employed: a spinning solution containing the aminosiloxane and/or chemical substance is spun; a method wherein a precursor tow in a water-swollen state obtained by spinning is treated with the aminosiloxane and/or chemical substance so that these substances can be introduced into said tow; a method wherein a precursor tow after drying and before the thermal stabilization treatment is treated with the aminosiloxane and/or chemical substance so that these substances can be introduced and contained in said tow, etc. In this way, the prescribed amounts of the aminosiloxane and chemical substance can be dispersed and introduced into the precursor tow before the thermal stabilization treatment. As mentioned above, when a water-swollen tow is used as the precursor tow according to the present invention, it is necessary, of course, that the treatment with the aminosiloxane and/or chemical substance should be carried out or accomplished while the tow is in a water-swollen state.

Thus, for the precursor tow used in the present invention, the prescription on the total number of single filaments and the introduction of the two particular treating substances are indispensable. An additional important matter besides these factors is to make the content of said two particular treating substance uniform throughout the whole precursor tow.

That is to say, when the presursor tow composed of X single filaments is so divided into Y portions (divided tows) that each divided tow will be composed of 1000 filaments $$\left(\text{i.e. } Y = \frac{X}{1000}\right),$$

it is indispensable that the number of divided tows whose content in the aminosiloxane is not more than 0.05 weight % based on the dry weight of the fibers, is not more than 10% relative to Y (total number of divided tows), and the number of divided tows whose content in said chemical substance is not more than 0.08 weight % based on the dry weight of the fibers, is not more than 20% relative to Y. If the number of divided tows containing the aminosiloxane in said weight % exceeds 10%, or if the number of divided tows containing the chemical substance in said weight % exceeds 20%, there will be observed the generation of static electricity between single filaments of the precursor tow, poor bundling properties, agglutination, fusion, etc., and it is impossible to produce a high-quality carbon tow having excellent physical properties.

For example, suppose that the total number of single filaments (X) of a precursor tow is 20,000, then the number of divided tows (Y) will be 20

$$\left(Y = \frac{20{,}000}{1{,}000} = 20\right).$$

For each of the 20 divided tows, the average content of the aminosiloxane and that of the chemical substance (for instance polyethylene glycol) are measured. When all of the 20 divided tows contain an amount exceeding 0.05 weight % aminosiloxane and an amount exceeding 0.08 weight % polyethylene glycol, there is no problem. But if there are three or more tow in the 20 divided tow containing not more than 0.05 weight % aminosiloxane, the above-mentioned troubles will occur and it is impossible to obtain carbon tows having excellent physical properties.

To diminish the variation in the content of the chemical substances such as aminosiloxane and polyethylene glycol between the divided tows, the treating concentration, treating time and treating temperature of the treating substances for the precursor tow should be suitably modified. As regards the treating concentration of the treating substances, it is recommended to use a concentration of 0.5–5.0% for aminosiloxane and a concentration of 0.7–7% for the chemical substance (both for the treatment with each single substance and with the two substances at the same time). The treating time is closely related to the treating speed, and at a treating speed of 100 m/min, a treating time of 0.5 second or more, and at a treating speed of 150 m/min, a treating time of 0.8 second or more is preferable. As regards the treating temperature, a temperature from room temperature to 70° C. is desirable. As an additional means for preventing the variation in the amounts of absorption, it is desirable to employ the following method: the method consists in adjusting the width of the precursor tow travelling in the treating bath to 5–10 cm for a number of constituent single filaments of 10,000, and the width of the tow after leaving the treating bath to 0.5 to 2 cm for a number of constituent single filaments of 10,000. An adjusting means for the former is to spread the tow width by blowing the treating liquid against the tow through a nozzle installed in the treating bath and then to bundle the tow with a roller installed outside the bath, this spreading and bundling operation being repeated. An adjusting means for the latter is to use tow width controlling rollers installed outside the treating bath. As other adjusting means for the former and the latter, there may be mentioned the use of cross rollers, the use of a folding operation, etc. according to circumstances.

Upon producing a carbon tow from a precursor tow into which such a particular aminosiloxane and chemical substance have been introduced uniformly, conventional known heat treating processes can be employed. In general, there is employed a heat treating process consisting of a thermal stabilization step in which the tow is heated at 200°–350° C. in an oxidizing atmosphere and a subsequent carbonization step in which the tow is heated at a higher temperature (above 800° C.) in a non-oxidizing atmosphere or under reduced pressure.

As the atmosphere for thermal stabilization, air is suitable, but it is also possible to employ a thermal stabilization method which is carried out in the presence of sulfurous acid gas or nitrogen monoxide gas, or under the irradiation of light. As the atmosphere for carbonization or graphitization, nitrogen, helium, argon, etc. are used by preference. Additionally, in order to produce a carbon tow with a higher tensile strength and a higher modulus of elasticity, it is preferable to carry out the heat treatment under tension (generally 0.1–0.5 g/d). Particularly effective is to apply tension in the thermal stabilization step and the carbonization step or the graphitization step.

Thus, by employing the process of the present invention, it has become possible to produce carbon tows having an excellent tensile strength and modulus of elasticity at a high production efficiency and in a short time. Accordingly, such carbon tows having excellent properties are now used in the wide field of reinforcements, heating elements, refractory materials, etc.

For a better understanding of the present invention, representative examples are shown in the following. In the examples percentages and parts are by weight unless otherwise indicated.

EXAMPLE 1

A spinning solution prepared by dissolving 9 parts of an acrylonitrile copolymer consisting of 98% acrylonitrile and 2% methacrylic acid in 91 parts of a 47% aqueous solution of sodium thiocyanate, was extruded through a spinnerette (40,000 spinning orifices) into a 12% aqueous solution of sodium thiocyanate to coagulate the spinning solution. After water-washing, cold stretching (three times in length), and hot water stretching (4 times) in boiling water, a precursor tow in a water-swollen state containing 135% water was obtained. Thereafter, this precursor tow was immersed into an aqueous emulsion of the aminosiloxane ($NH_2$ content 0.5%) shown in the following formula:

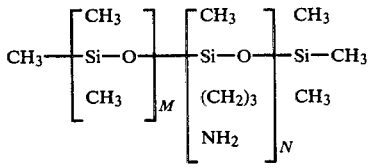

and a precursor tow (single-filament denier 1.5) containing 0.3% of the above-mentioned aminosiloxane was obtained.

Thereafter, this tow was further immersed into an aqueous solution of polyethylene glycol (400), and Sample Nos. 1–6 in Table 1 were prepared by suitably regulating the mangle squeeze ratio. These tows were thereafter supplied through rollers to a heating furnace (180° C.), and then to the thermal stabilization step. The state of the generation of static electricity and operability in this step are also shown in Table 1.

TABLE 1

| Sample no. | Quantity of polyethylene glycol introduced (%) | Generation of static electricity | Operability |
|---|---|---|---|
| 1 | 0.05 | a little | fairly bad |
| 2 | 0.1 | no | good |
| 3 | 0.25 | no | good |
| 4 | 0.50 | no | good |

TABLE 1-continued

| Sample no. | Quantity of polyethylene glycol introduced (%) | Generation of static electricity | Operability |
|---|---|---|---|
| 5 | 5.20 | no | bad; rollers were polluted |
| 6 | 0 | remarkable | very bad |

It is understood from the results in Table 1 that good operability can be obtained when the two kinds of the particular treating substances of the present invention are used in combination. On the other hand, it was attempted to once dry the water-swollen tows and then to supply them to said heating furnace. In the case of Sample Nos. 1 and 6, the generation of static electricity was remarkable, and much fluff was generated, so that continuous treatment was difficult. In the case of Sample Nos. 2–5, some fluff was generated but continuous operation was not hindered.

In the same way as above except that in place of the above-mentioned spinnerette, spinnerettes having 1000 and 5000 orifices were used, two kinds of precursor filament bundles with a single-filament denier of 1.5 were obtained. Without using polyethylene glycol in combination, there was no problem in operation for both, but when eight tows each composed of 5000 single filaments were produced and united, and the united tow was subjected to thermal stabilization and carbonization, there was a remarkable generation of static electricity, and consequently much entanglement of filaments around rollers took place. Moreover, ply separation occurred between the united bundles composing the tow, and therefore it was difficult to apply a uniform tension to the tow. In addition, because of thickness unevenness of the tow in the direction of tow width, there occurred, in the thermal stabilization step, filamenent breakage owing to heat accumulation at thicker portions, and it was impossible to obtain a thermally stabilized satisfactory tow continuously.

EXAMPLE 2

The water-swollen precursor tow obtained in Example 1 was treated in a treating bath in which the aminosiloxane and polyethylene glycol of Example 1 were present together, while varying the treating conditions as shown in Table 2, so as to fix them to the tow in amounts of 0.25% and 0.4% based on the dry weight of the fibers, respectively. Six kinds of the thus obtained tows (Sample Nos. 7–12) were each divided into 40 portions, and the contents of the treating substances in the respective divided tows were evaluated. The results are shown in Table 2.

Each of the presursor tows (Sample Nos. 7–12) was supplied continuously to a heating furnace so that the tow would stay in the furnace for three minutes. Thereafter, each of the tows was introduced into a thermal stabilization furnace at 240° C. so that it would be subjected to a thermal stabilization treatment for 60 minutes, followed by a carbonization treatment at 300°–800° C. for two minutes in a nitrogen atmosphere to obtain carbon tows. The physical properties of the carbon tows are also shown in Table 2.

From the results in Table 2, it is understood that, from Sample Nos. 9–12 whose variation in the contents of the treating substances is outside the limits prescribed in the present invention, it is impossible to obtain a carbon tow having satisfactory physical properties.

TABLE 2

| Sample no. | Treating conditions: Conc. of AM (%) | Conc. of PEG (%) | Time (sec.) | Width of immersed tow (cm) | Percent of divided tows whose content AM is not more than 0.05 wt % | Percent of divided tows whose content in PEG is not more than 0.08 wt % | Physical properties of carbon tow: Tensile strength (kg/mm²) | Tensile Modulus (ton/mm²) |
|---|---|---|---|---|---|---|---|---|
| 7 | 1.0 | 1.5 | 1.2 | 30 | 10 | 10 | 324 | 24.7 |
| 8 | 1.0 | 0.8 | 1.2 | 30 | 10 | 20 | 314 | 24.5 |
| 9 | 0.3 | 1.5 | 1.2 | 30 | 20 | 10 | 256 | 23.7 |
| 10 | 1.0 | 1.5 | 0.48 | 30 | 20 | 20 | 253 | 23.6 |
| 11 | 1.0 | 0.5 | 1.2 | 30 | 10 | 30 | 245 | 23.7 |
| 12 | 1.0 | 1.5 | 1.2 | 15 | 30 | 40 | 240 | 23.6 |

Note:
Treating speed: 100 m/min
Treating temperature: 40° C.
The tow width leaving the treating bath was maintained constant at 4 cm.
AM = aminosiloxane
PEG = polyethylene glycol

What is claimed is:

1. A process for producing carbon fiber tows from acrylic fiber tows, characterized by introducing an acrylic fiber tow, whose total number X of single filaments composing said tow is 10,000 or more, into a treating bath containing 0.5–5.0 weight % of an aminosiloxane represented by the general formula given hereunder and 0.7–7.0 weight % of a chemical substance selected from the group consisting of glycerine, an alkylene glycol whose number of carbon atoms is not less than 6 and a polyalkylene glycol whose number of carbon atoms is not less than 20, or into treating baths containing each respectively; regulating the tow width in the treating bath or baths to 5–10 cm per 10,000 filaments; treating the tow for a period of not less than 0.5 second; thereby preparing an acrylic fiber tow such that, when said tow is divided into Y tow portions so that each divided tow will be composed of 1000 filaments represented by Y=(X/1000), the number of divided tows whose content in the aminosiloxane is not more than 0.05 weight % based on the dry weight of the fibers, is not more than 10% relative to Y and the number of divided tows whose content in said chemical substance is not more than 0.08% based on the dry weight of the fibers, is not more than 20% relative to Y; and then heat-treating said acrylic fiber tow to produce a carbon fiber tow; said general formula of the aminosiloxane being:

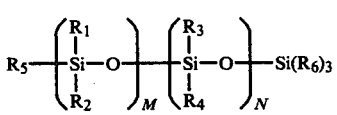

wherein each of $R_1$, $R_2$ and $R_3$ represents hydrogen, methyl, ethyl, or phenyl; $R_4$ represents $-C_nH_{2n}-$, wherein n is an integer from 1 to 10, or phenylene; each of $R_5$ and $R_6$ represents hydrogen or $-C_nH_{2n+1}$, wherein n is an integer from 1 to 5; each of M and N represents an integer from 1 to 100,000, wherein M+N<10; A represents

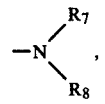

wherein each of $R_7$ and $R_8$ represents hydrogen or alkyl whose number of carbon atoms is not more than 10, or phenyl, or

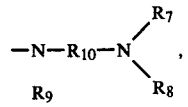

wherein $R_9$ represents H, $C_nH_{2n+1}$ in which n=1–5 or phenyl; and $R_{10}$ represents $C_nH_{2n}$ in which n=1–10 or phenylene.

2. A process as claimed in claim 1 wherein the acrylic fiber tow is made of an acrylonitrile copolymer containing at least 85 mol % of acrylonitrile and 0.3–6 mol % of a carboxyl group-containing unsaturated monomer.

3. A process as claimed in claim 1 wherein the chemical substance is selected from the group consisting of glycerine, ethylene glycol, propylene glycol, butylene glycol, polyethylene glycol, polypropylene glycol and polybutylene glycol.

4. A process as claimed in claim 1 wherein said aminosiloxane and the chemical substance are incorporated into the acrylic fiber tow by (1) treating the tow in a water-swollen state with the aminosiloxane and/or the chemical substance, or by (2) treating the tow before the thermal stabilization treatment with the aminosiloxane and the chemical substance, or by (3) a combination of any of two or more of (1) and (2).

5. A process as claimed in claim 1 wherein the width of the tow is spread by blowing against the tow, the treating liquid through a nozzle fixed in the treating bath or baths.

6. A process as claimed in claim 1 wherein the tow upon leaving the treating bath or baths is regulated so as to have a width of 0.5–2 cm per 10,000 single filaments composing the tow.

* * * * *